US011196215B2

(12) United States Patent
Xu et al.

(10) Patent No.: US 11,196,215 B2
(45) Date of Patent: Dec. 7, 2021

(54) ELECTRICAL CONNECTOR EQUIPPED WITH A MOUNTING MEMBER

(71) Applicants: FOXCONN COMPUTER CONNECTOR CO., LTD., Kunshan (CN); FOXCONN INTERCONNECT TECHNOLOGY LIMITED, Grand Cayman (KY)

(72) Inventors: Guang-Lei Xu, Kunshan (CN); Zhi-Bin Zhao, Kunshan (CN)

(73) Assignees: FOXCONN (KUNSHAN) COMPUTER CONNECTOR CO., LTD., Kunshan (CN); FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 71 days.

(21) Appl. No.: 16/691,178

(22) Filed: Nov. 21, 2019

(65) Prior Publication Data

US 2020/0161806 A1 May 21, 2020

(30) Foreign Application Priority Data

Nov. 21, 2018 (CN) ..... 201811387185.0

(51) Int. Cl.
*H01R 13/627* (2006.01)
*H01R 13/629* (2006.01)

(52) U.S. Cl.
CPC ..... *H01R 13/6273* (2013.01); *H01R 13/629* (2013.01)

(58) Field of Classification Search
CPC .... H01R 13/64; H01R 13/629; H01R 13/627; H01R 13/6273
See application file for complete search history.

(56) References Cited

U.S. PATENT DOCUMENTS 5,279,507 A * 1/1994 Kameyama ..... B60R 16/0222 439/270
5,613,876 A * 3/1997 Sakatani ..... B60R 16/02 296/146.5
7,674,130 B2 * 3/2010 Giefers ..... H01R 13/745 439/557
9,948,031 B2 * 4/2018 Tamaki ..... H01R 12/707
10,141,689 B2 * 11/2018 Tamaki ..... H01R 13/641

FOREIGN PATENT DOCUMENTS

CN 206908021 U * 1/2018
CN 206908021 U 1/2018

* cited by examiner

*Primary Examiner* — Abdullah A Riyami
*Assistant Examiner* — Nader J Alhawamdeh
(74) *Attorney, Agent, or Firm* — Ming Chieh Chang; Wei Te Chung

(57) ABSTRACT

An electrical connector comprises an insulative module loaded with terminals therein and a mounting member. The insulative module defines a pair of panel-supporting surface at each opposite end thereof, and a cavity going through one panel-supporting face. The mounting member comprises a board main receiving in the cavity and an operating portion projecting outwards. The insulative module defines a pair of elastic arms slanting into the cavity and each slates away from the panel-supporting face. The board main defines a pair of locking recesses at opposite edges thereof. The elastic arms are locked with the locking recesses in condition that the mounting member slides upwards beyond the panel-supporting faces.

20 Claims, 8 Drawing Sheets

ELECTRICAL CONNECTOR EQUIPPED WITH A MOUNTING MEMBER

BACKGROUND OF THE INVENTION

1. Field of the Invention

The present invention relates to an electrical connector, and particularly to the electrical connector equipped with a mounting member to secure the electrical connector in an opening defined on a panel.

2. Description of Related Arts

China Utility Patent Issued No. CN206908021U discloses a power connector with sliding structure, comprising a module, a mounting panel and an elastic locking portion. The module has a plurality of socket modules and two fixing modules. A locking device is disposed at one of the fixing modules, and the locking portion is inserted into the locking device. The mounting panel defines a mounting opening, and the module is inserted into the mounting opening. However, the elastic portion of the locking portion is vulnerable.

It is desirable to provide an improved electrical connector.

SUMMARY OF THE INVENTION

An object of the invention is to provide an electrical connector. The electrical connector comprises an insulative module loaded with terminals therein and a mounting member. The insulative module defines a pair of panel-supporting surfaces at each of opposite ends thereof, and a cavity going through one panel-supporting surface. The mounting member comprises a board main receiving in the cavity and an operating portion projecting outwards. The insulative module defines a pair of elastic arms slanting into the cavity and each slants away from the panel-supporting surface. The board main defines a pair of locking recesses at opposite edges thereof. The elastic arms are locked with the locking recesses in condition that the mounting member slides upwards beyond the panel-supporting surface.

DETAILED DESCRIPTION OF THE PREFERRED EMBODIMENT

Figure 1:
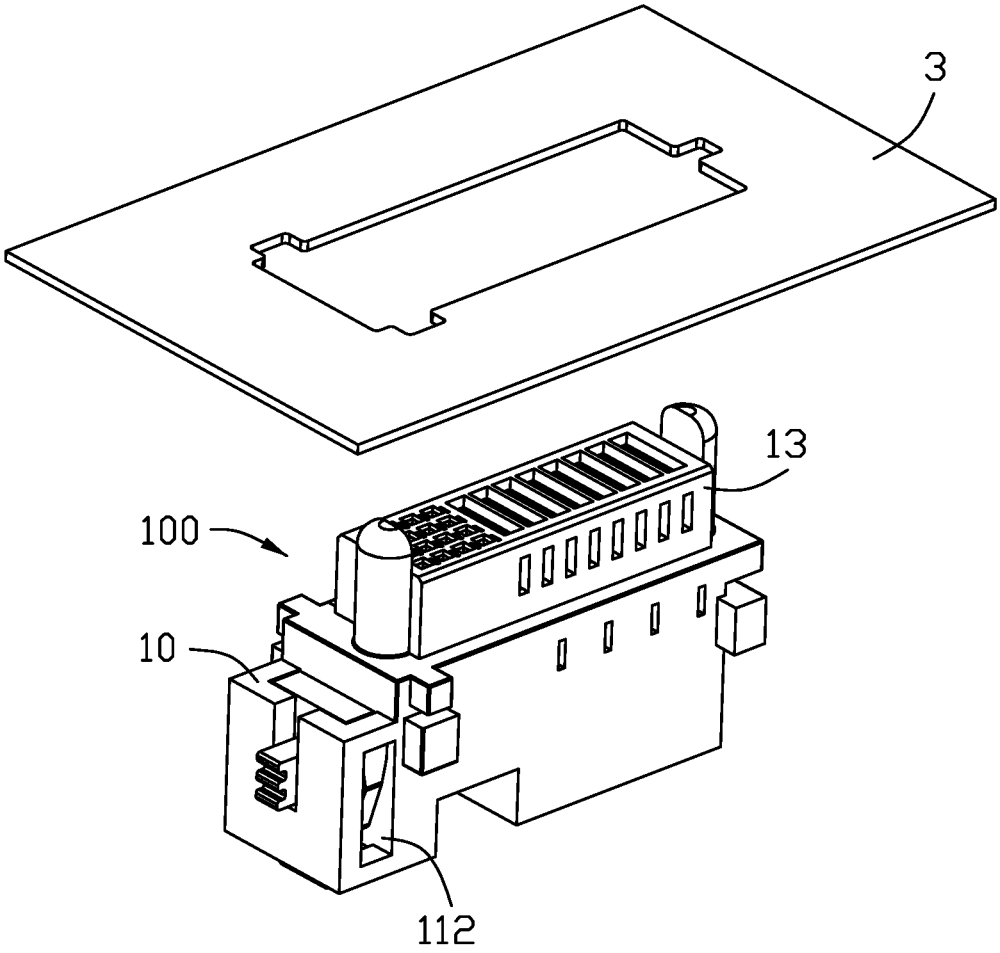
FIG. 1 is a perspective view of an electrical connector and a panel discrete from the panel of a preferred embodiment of the invention.
Figure 2:
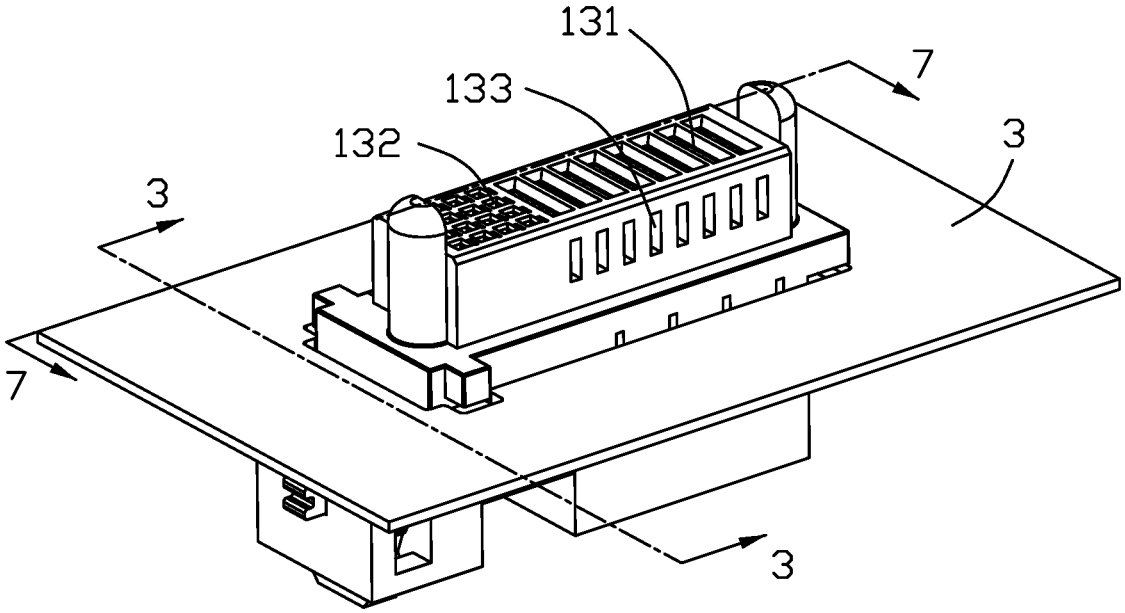
FIG. 2 is a perspective view of the electrical connector which is inserted into the panel, of FIG. 1.

Referring to FIGS. 1-8, an electrical connector 100 of the preferred embodiment is adapted for retaining in an opening

31 of the panel, and comprises an insulative module 1 loaded with terminals therein and a mounting member 2. The insulative module/housing 1 defines a pair of panel-supporting surface 10 at each opposite end thereof, and a cavity 11 going through one panel-supporting surface 10. The mounting member 2 comprises a board main 20 receiving in the cavity 11 and an operating portion 22 projecting laterally outwards. The mounting member 2 is assembled to the cavity 11 in a vertical direction from an upper opening (not label) of the cavity 11. The board main 20 defines a pair of locking recesses 21 at opposite edges thereof. The insulative module 1 defines a pair of elastic arms 12 slanting into the cavity 11 and each slants away from the panel-supporting surface 10. The elastic arms 12 are locked with the locking recesses 21 in condition that the mounting member 2 slides upwards beyond the panel-supporting surface 10.

Referring to FIGS. 1-4, the insulative module 1 has a mating portion 13 extending upwardly. The mating portion 13 has a pair of guiding posts at opposite sides which extend beyond the top surface of the mating portion 13. The mating portion 13 defines a plurality of first terminal grooves 131 with rectangle top view and a plurality of second terminal groove 132 with square top view. The mating portion 13 further defines a plurality of holes 133 extending through the first terminal grooves 131 in a horizontal direction.

Figure 4:
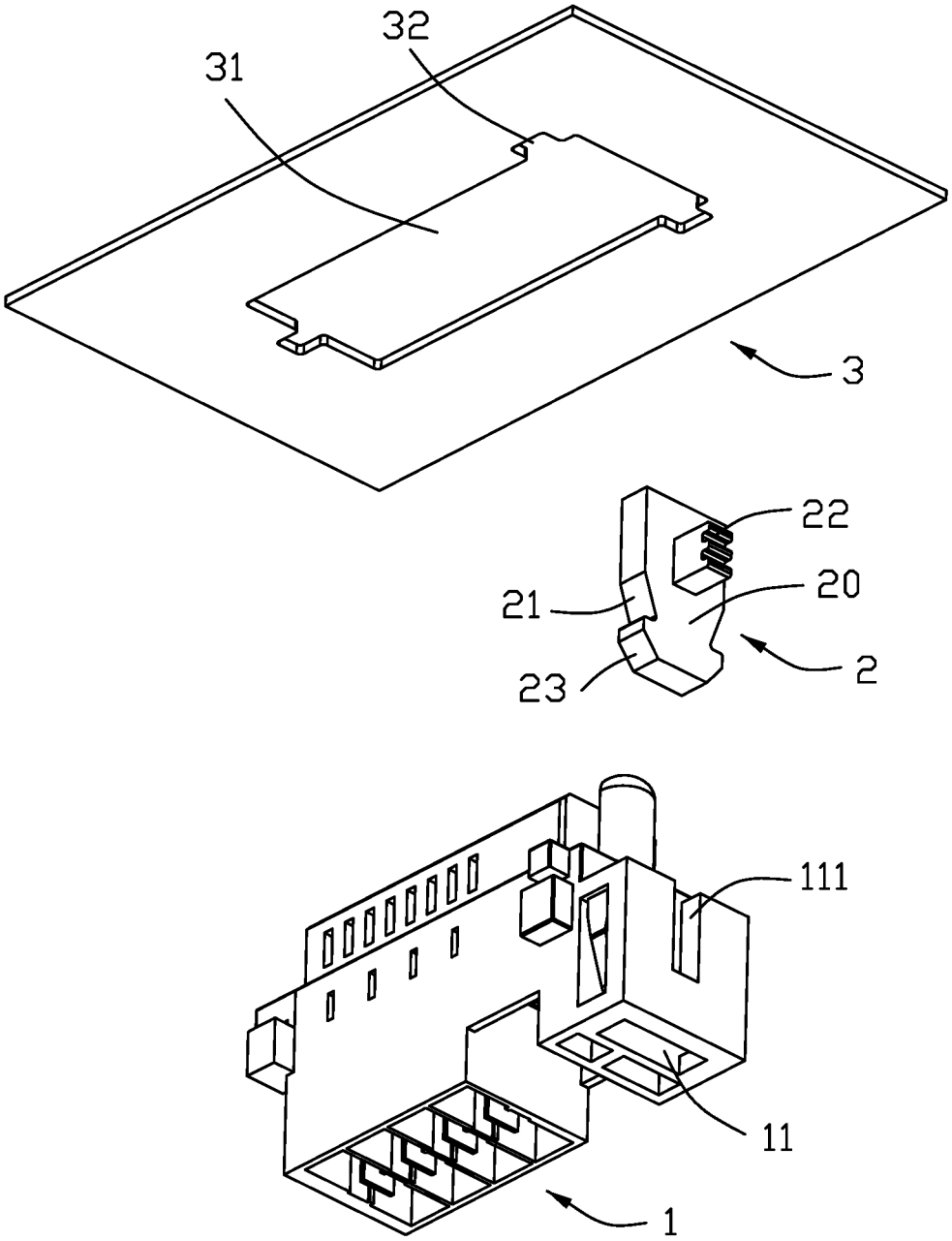
FIG. 4 is an exploded perspective view of the electrical connector and the panel of FIG. 1.

As shown in FIG. 4, the operating portion 22 is used for a user operates and extends from the outer larger face of the board main 20, while the locking recesses 21 are located on the opposite smaller faces of the board main 20. The insulative module 1 defines a sliding slot 111 opening upwards and laterally outwards. The operating portion 22 slide in the sliding slot 111 in the vertical direction.

Each of the elastic arms 12 includes a horizontal connecting portion 121 and an inward-projecting locking portion 122 at a free end thereof corresponding to the locking recess 21. The locking portion defines an arc boss 122 which can slide into the locking recess. The insulative module 10 further defines openings 112 to accommodate the elastic arms 12. Each of the elastic arms 12 is exposed to the corresponding opening 112. Each of the openings 112 is an elongated rectangle extending in the vertical direction. The elastic arms 12 extend downwardly from the top inner surface 113 of the openings 112 and are spaced from the outer surface of the cavity 11. In the vertical direction, the length of the opening 112 is greater than the length of the elastic arm 12. The dimension between the connecting portions 121 of the two elastic arms 12 is greater than the corresponding dimension of the mounting member 2.

Figure 3:
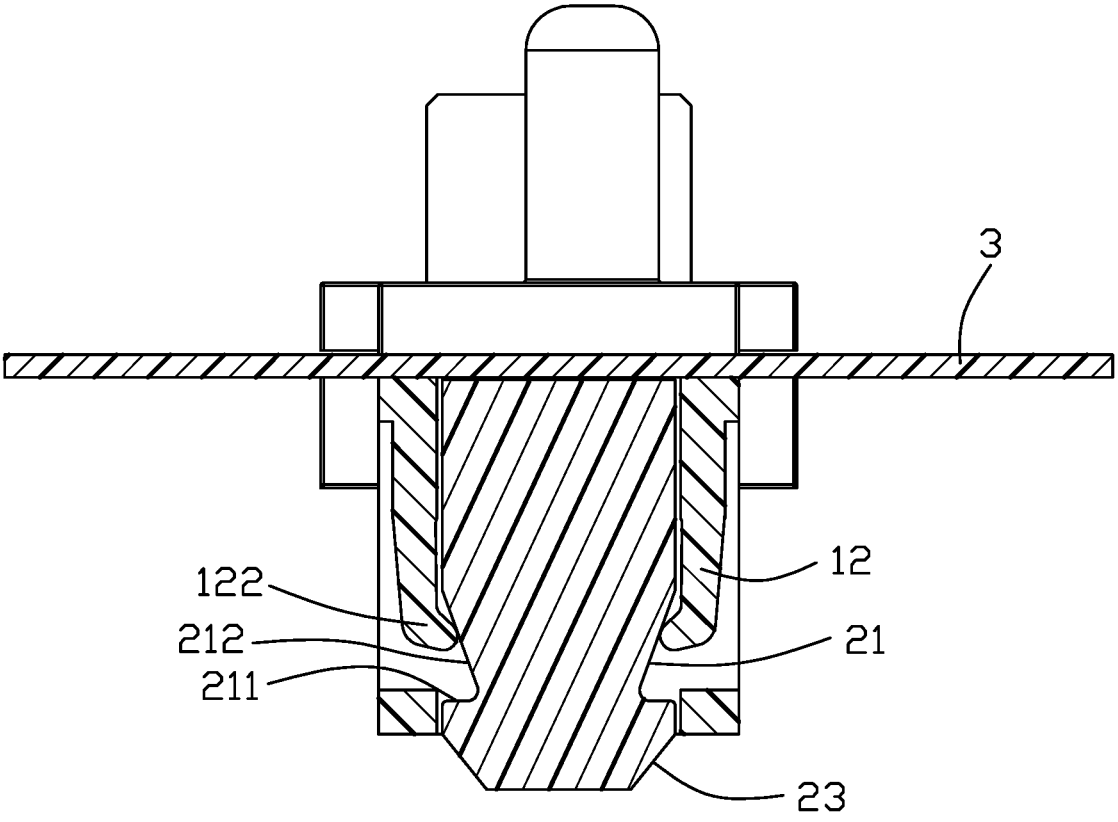
FIG. 3 is a cross-sectional view of the electrical connector of FIG. 2 taken along lines 3-3.
Figure 6:
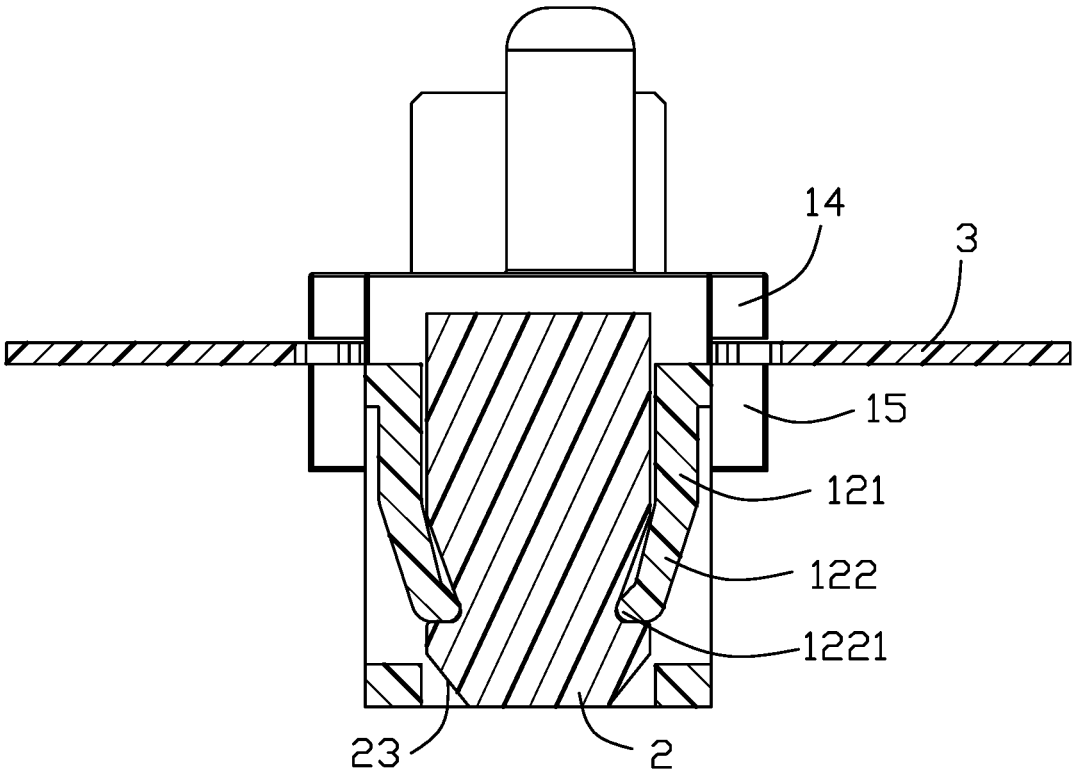
FIG. 6 is a cross-sectional view of the electrical connector of FIG. 5 taken along lines 6-6.

Referring to FIG. 3, the locking recesses 21 are located near to a bottom of the board main 20 and each consists of an upper sloping face 212 and a lower horizontal face 211 continuing the upper sloping face 212. Referring to FIG. 6, the arc boss 1221 of the locking portion 122 slide along the upper sloping face 212 until the arc boss 1221 arrive the corner connecting with upper sloping face 212 and the lower horizontal face. The mounting member 2 has two chamfer corners 23 at a bottom thereof.

The electrical connector 100 is inserted into the mounting opening 31 of the panel 3 along a lower-to-upper direction. The panel 3 defines a mounting opening 31 to receive the insulative module 1. The insulative module 1 comprises a first holding/retaining block 14 and a second holding/retaining block 15 which are spaced apart from each other. In the lateral direction, the width of the first holding block 14 is smaller than the width of the second retaining block 15. The mounting opening 31 defines a limiting hole 32 corresponding to the first holding block 14. The dimension of the limiting hole 32 is larger than the dimension of the first limiting block 14, but smaller than the dimension of the second limiting block 15. The panel 3 is located between the first holding block 14 and the second holding block 15.

Figure 7:
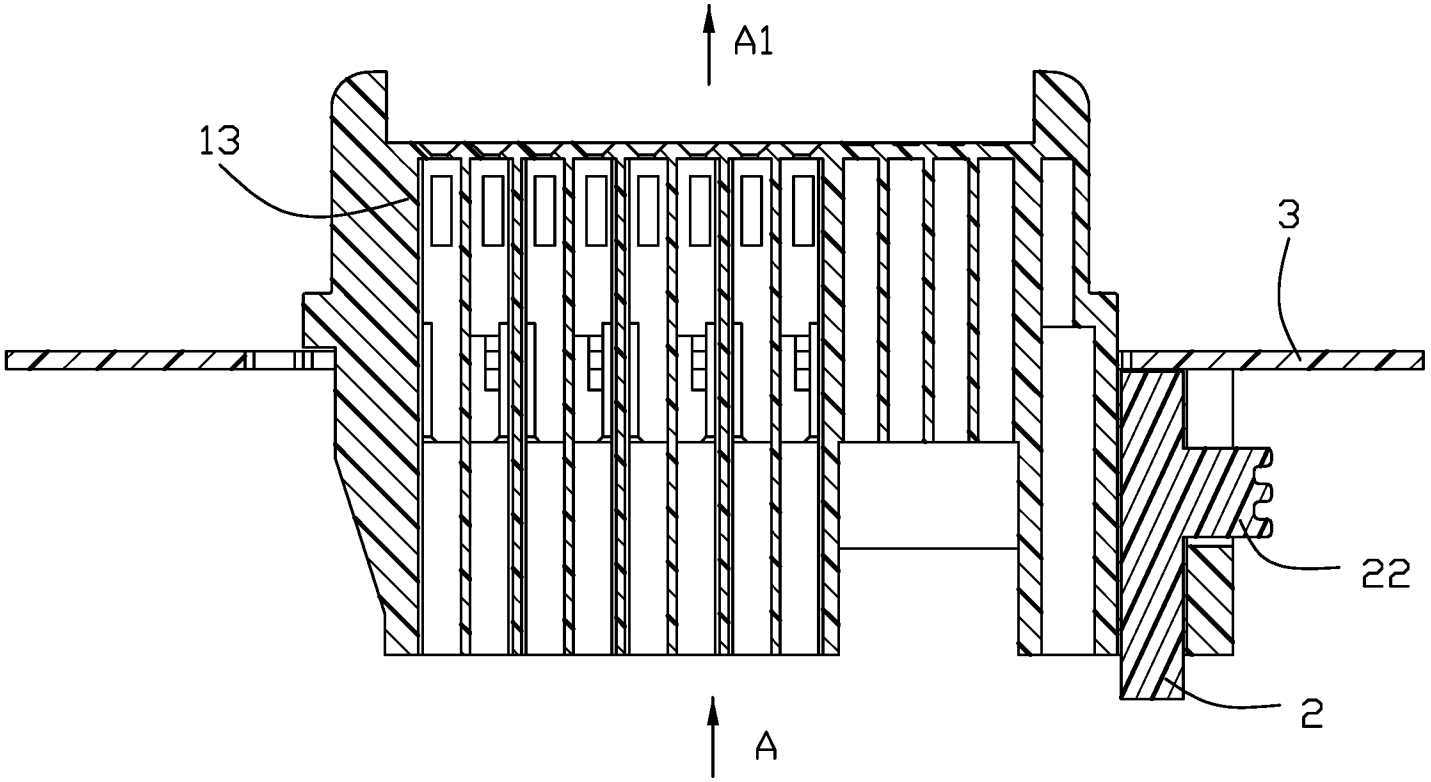
FIG. 7 is a cross-sectional view of the electrical connector of FIG. 2 taken along lines 7-7.
Figure 8:
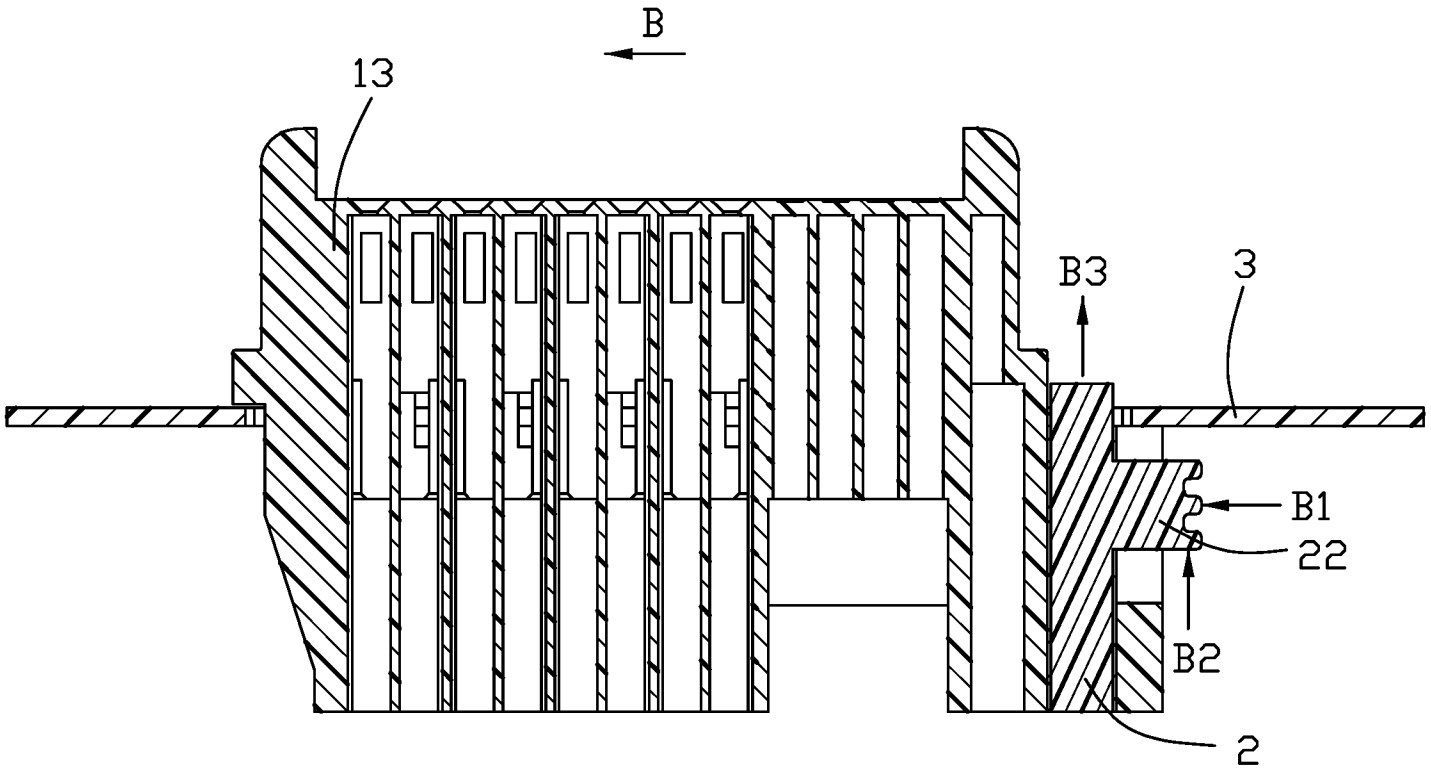
FIG. 8 is a cross-sectional view of the electrical connector of FIG. 5 taken along lines 8-8.

Referring to FIGS. 7-8, a method of the electrical connector 100 mounting in the panel 3 is described as following two steps.

In a first step, the electrical connector 100 is inserted into the mounting opening 31 along a first direction perpendicular to the panel or the vertical direction as shown arrow A. The mating portion 13 protrudes upwards from the mounting opening 31 in the direction of the arrow A1. The limiting hole 32 of the panel 3 is located between the first holding block 14 and the second holding blocks 15. The panel-supporting surface 10 of the insulative module is abutted against the lower surface of the panel 3. The cavity 11 is blocked by the panel 3.

In a second step, the electrical connector 100 moves to a locking position along the arrow B by a force $B_1$. The upper opening of the cavity 11 is exposed to the mounting opening 31 without being blocked. The operating portion 22 is moved upwardly along the arrow B2, so that the mounting member 2 protrudes from the cavity 11 along the arrow B3. The other supporting surface of the electrical connector 100 is located at the upper surface of the panel 3.

Figure 5:
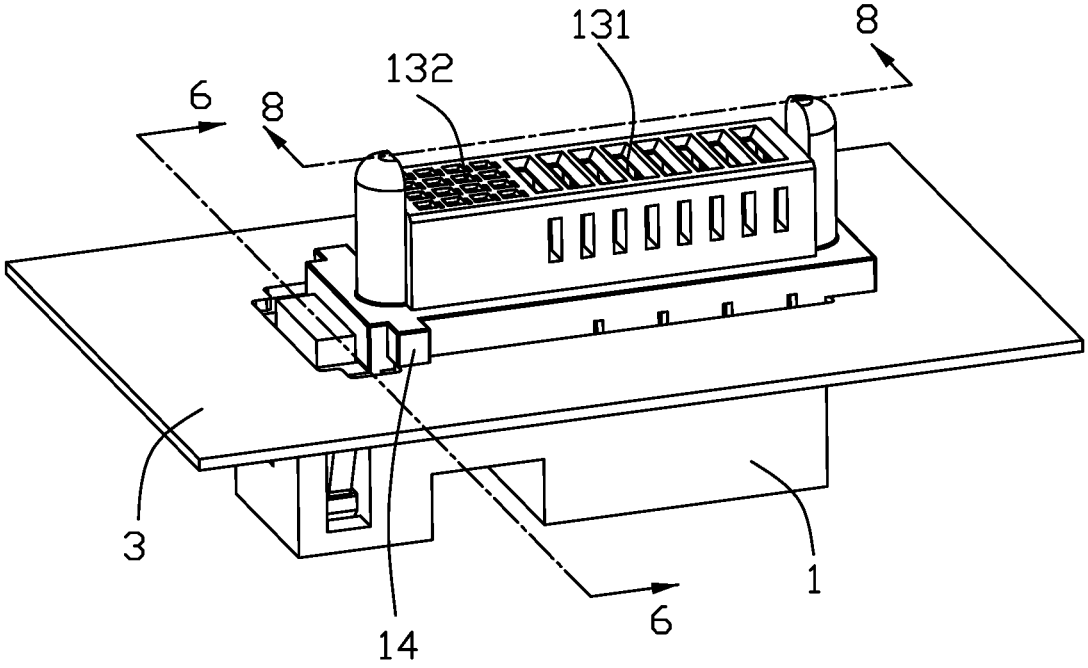
FIG. 5 is a perspective view of the electrical connector which is located at a locking position, of FIG. 2.

Referring to FIGS. 5-6, the electrical connector 100 is mounted to the panel 3 and then moved to the locking position. The first and second holding blocks 14, 15 sandwich the inner edge of the mounting opening 31, and the panel 3 blocks the upper opening of the sliding slot 111. Notably, the (first) panel supporting surface 10 faces toward the exterior in a first vertical direction while the first holding block 14 as well as an end of the insulative module 1, which is opposite to the mounting member 2, forms another (second) panel supporting surface (not labeled) facing toward the exterior in a second vertical direction opposite to the first vertical direction, so as to retain the panel 3 therebetween in the vertical direction. Understandably, the connector is initially inserted into the mounting opening 31 in the first vertical direction with the holding block 14 extending through the corresponding limiting hole 32 until the (first) panel supporting surface 10 abuts against the back surface of the panel 3 in the first vertical direction, and successively moved horizontally in a longitudinal direction from the first/original horizontal position to the second/final horizontal position to have the holding block 14 is moved away from the corresponding limiting hole 32 horizontally in an offset manner so as to have another/second panel supporting surface abut against the back surface of the panel 3 in a second vertical direction. Finally, the moveable mounting member 2 is moved into the mounting opening 31 and from the first/original vertical position to the second/final vertical position in the first vertical direction to prevent backward movement of the connector in an opposite longitudinal direction wherein the mounting member 2 is equipped with the resilient mechanism to constantly urge the mounting member 2 located in a forward position for assuring the electrical connector is stably positioned upon the panel 3. The electrical connector is able to be moved back to the original/first horizontal position only after the mounting member 2 is moved back to the original/first vertical position from the final/second vertical position.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector, comprising:

an insulative module defining a pair of panel-supporting surfaces at each of opposite ends thereof, and a cavity going through one panel-supporting surface, and loaded with terminals therein;

a mounting member comprising a board main received in the cavity and an operating portion projecting outwards; wherein the insulative module defines a pair of elastic arms slanting into the cavity and each slating away from the panel-supporting surface, the board main defines a pair of locking recesses at opposite edges thereof, and the elastic arms constantly urge the board main to be at a locked position where the elastic arms are locked with corresponding locking recesses and the mounting member slides upwards beyond the panel-supporting face.

2. The electrical connector as claimed in claim 1, wherein the operating portion laterally extends from a larger side of the mounting member and slides in a sliding slot of the insulative module opening upwards and laterally outwards and the locking recesses are disposed on opposite smaller sides of the board main.

3. The electrical connector as claimed in claim 1, wherein the locking recesses are located near to a bottom of the board main and each consists of an upper sloping face and a lower horizontal face continuing the upper sloping face.

4. The electrical connector as claimed in claim 1, wherein each of the elastic arms includes an inward-projecting locking portion at a free end thereof corresponding to the locking recess.

5. The electrical connector as claimed in claim 1, wherein the mounting member includes two chamfer corners at a bottom thereof.

6. The electrical connector as claimed in claim 4, wherein the insulative module defines openings to accommodate with corresponding elastic arms, and the openings run through the insulative module laterally.

7. The electrical connector as claimed in claim 6, wherein each of the elastic arms extends downwardly from the upper inner surface of the opening and is spaced from an outer surface of the cavity.

8. The electrical connector as claimed in claim 1, wherein the insulative module includes a first holding block and a second holding block which are spaced apart from each other, and a width of the first holding block in a lateral direction is smaller than a width of the second holding block in the lateral direction.

9. The electrical connector as claimed in claim 1, wherein the mounting member is inserted into the cavity from an upper opening of the cavity.

10. An electrical connector adapted for being retained in an opening of a panel, the electrical connector comprising:

an insulative module located with terminals and defining a cavity;

a mounting member received in the cavity and slidable in a first direction perpendicular to the panel, the insulative module being laterally shiftable to project a distal end of the mounting member in the opening of the panel so as to retain the insulative module in the opening; wherein the insulative module defines a pair of elastic arms slating into the cavity with locking ends thereof away from the panel and the mounting member defines a pair of locking recesses to lock with the locking ends when the distal end of the mounting member is in the opening of the panel.

11. The electrical connector as claimed in claim 10, wherein the mounting member comprises a board main receiving in the cavity and an operating portion extending laterally outward the insulative module.

12. The electrical connector as claimed in claim 11, wherein the insulative module defines a sliding slit opening upwards and laterally at same time to receive the operating portion.

13. The electrical connector as claimed in claim 12, wherein the board main is inserted from an upper opening of the cavity.

14. An electrical connector assembly comprising:

a panel forming a mounting opening with a limiting hole around a periphery of said mounting opening;

an electrical connector including:

an insulative housing defining a first panel supporting surface facing toward an exterior in a first vertical direction, and a second panel supporting surface facing toward the exterior in a second vertical direction opposite to the first vertical direction, said housing being dimensioned to be adapted to move back and forth horizontally between opposite first and second horizontal positions; and a mounting member associated with the housing and back and forth moveable in said first vertical direction and said second vertical direction between first and second vertical positions; wherein one of the housing and the mounting member is equipped with resilient mechanism to constantly and automatically urge said mounting member to be constantly located at the first vertical position.

15. The electrical connector assembly as claimed in 14, wherein the housing forms a cavity in which the mounting member is received.

16. The electrical connector assembly as claimed in claim 14, wherein the mounting member includes an exposed operation portion which is back and forth movable in said first vertical direction and said second vertical direction.

17. The electrical connector assembly as claimed in claim 14, wherein said resilient mechanism is an elastic arm unitarily formed on the housing.

18. The electrical connector assembly as claimed in claim 17, wherein said elastic arm is deflectable in a vertical plan.

19. The electrical connector assembly as claimed in claim 18, wherein said vertical plane is perpendicular to a longitudinal direction of the housing.

20. The electrical connector assembly as claimed in claim 17, wherein said elastic arm is received within a recess formed in the mounting member.

* * * * *